US008292971B2

(12) United States Patent
Choi

(10) Patent No.: US 8,292,971 B2
(45) Date of Patent: Oct. 23, 2012

(54) METHOD OF TREATING FABRIC CONDITIONER FOR WASHABLE SILK PRODUCTS

(76) Inventor: Man Soo Choi, Gwangju-si (KR)

( * ) Notice: Subject to any disclaimer, the term of this patent is extended or adjusted under 35 U.S.C. 154(b) by 0 days.

(21) Appl. No.: 13/126,443

(22) PCT Filed: Oct. 27, 2008

(86) PCT No.: PCT/KR2008/006325

§ 371 (c)(1),
(2), (4) Date: Apr. 27, 2011

(87) PCT Pub. No.: WO2010/050629

PCT Pub. Date: May 6, 2010

(65) Prior Publication Data

US 2011/0203054 A1 Aug. 25, 2011

(51) Int. Cl.

| | |
|---|---|
| ***D06M 15/00*** | (2006.01) |
| ***D06M 14/06*** | (2006.01) |
| ***D01C 3/02*** | (2006.01) |

(52) U.S. Cl. ..... 8/128.3; 8/128.1; 8/115.51

(58) Field of Classification Search ..... 8/128.3, 8/128.1, 115.51

See application file for complete search history.

(56) References Cited

U.S. PATENT DOCUMENTS

| | | | |
|---|---|---|---|
| 4,913,828 | A | 4/1990 | Caswell et al. |
| 5,514,302 | A | 5/1996 | Brown |
| 5,635,103 | A | 6/1997 | Willey et al. |

FOREIGN PATENT DOCUMENTS

| | | | |
|---|---|---|---|
| DE | 4022383 | A1 * | 1/1991 |
| KR | 10-0861715 | | 9/2008 |

OTHER PUBLICATIONS

Derwent Acc-No. 1991-038095, published in Derwent-Week: 199914. English abstract for Sano et al. (or Ichikawa et al.) DE 4022383 A, attached as a PDF.*

International Search Report mailed Jun. 29, 2009 for PCT/KR2008/006325.

* cited by examiner

*Primary Examiner* — Harold Pyon
*Assistant Examiner* — Katie L Hammer
(74) *Attorney, Agent, or Firm* — Lowe Hauptman Ham & Berner, LLP

(57) ABSTRACT

The present invention relates to a method of treating fabric conditioner for washable silk products, which can provide smoothness to silk products since fabric conditioners of different kinds are mixed and treated together and decrease whiteness or prevent yellowing.

1 Claim, No Drawings

METHOD OF TREATING FABRIC CONDITIONER FOR WASHABLE SILK PRODUCTS

CROSS REFERENCE TO RELATED APPLICATION

This application is the National Phase application of International Application No. PCT/KR2008/006325, filed Oct. 28, 2008, which designates the United States and was published in Korean. Each of these applications is hereby incorporated by reference in their entirety into the present application.

TECHNICAL FIELD

The present invention relates to a method of treating fabric conditioner for washable silk products, which can provide smoothness to silk products since fabric conditioners of different kinds are mixed and treated together and decrease whiteness or prevent yellowing.

BACKGROUND ART

In general, fabric conditioner serves to make cloth soft by reviving fabric texture and prevent static electricity since it neutralizes a negative ion fiber by absorbing a positive ion surfactant to the negative ion fiber. Moreover, the fabric conditioner serves to prevent fading of colors of cloth and the residue remaining from detergents. Recently, a multifunctional fabric conditioner for providing non-wrinkle effect to prevent wrinkles has been disclosed, but is not proper to silk products in many cases since it has a single-function. Accordingly, in many cases, the silk products are damaged when they are washed.

Generally, since textures of the silk products are very soft and sensitive, the silk products become wrinkled or cloth is spoiled due to a damage of the surface of silk fibers when the silk products are washed. Accordingly, since the silk products must be laundered through steam cleaning or oil cleaning in a cleaner's, it has a problem in that it costs a great deal to maintain the silk products. Furthermore, even though the fabric conditioner is used, the silk products may be damaged when they are dehydrated in a washing machine.

DISCLOSURE OF INVENTION

Technical Problem

Accordingly, the present invention has been made in an effort to solve the above-mentioned problems occurring in the prior arts, and it is an object of the present invention to provide a method of treating fabric conditioner, which can make silk products washable in water by repeating steps of mixing fabric conditioners of at least three kinds in a proper amount, submerging the silk products in water for a proper time period and dehydrating them.

Technical Solution

To achieve the above objects, the present invention provides a method of treating fabric conditioner for washable silk products comprising the steps of: (a) submerging silk products in underground water or tap water at temperature ranging from 15° C. to 25° C. for 15 minutes to 20 minutes, and dehydrating them; (b) after dehydration, mixing 0.33 g weight of the first conditioner consisting of propanediol, ethanaminium, 2-amino-N-hydroxyethylene sulfate, propanol, and 1,3-dioxane, 1.30 g weight of the second conditioner consisting of polyether denatured silicon, and 40 g weight of the third conditioner consisting of glacial acetic acid with 15 l of water per silk products of 1 kg, putting the mixture and the silk products in a rotating tub, and rotating them in the rotating tub for 5 minutes to 15 minutes; (c) after the (b) step, submerging the silk products in underground water or tap water again at water temperature ranging from 35° C. to 45° C. for 15 minutes to 25 minutes, and dehydrating them; (d) after dehydration, mixing 0.67 g weight of the first conditioner consisting of propanediol, ethanaminium, 2-amino-N-hydroxyethylene sulfate, propanol, and 1,3-dioxane, 2.50 g weight of the second conditioner consisting of polyether denatured silicon, and 60 g weight of the third conditioner consisting of glacial acetic acid with 15 l of water per silk products of 1 kg, putting the mixture and the silk products in the rotating tub, and rotating them in the rotating tub for 5 minutes to 15 minutes; and (e) dehydrating and drying the silk products.

MODE FOR THE INVENTION

In the present invention, fabric conditioners of three kinds used to provide softness to silk products are indicated as first to third conditioners. The first conditioner is VARI SOFT 222 LM90 (product name made by Gold Shmidt) consisting of propanediol, ethanaminium, 2-amino-N-hydroxyethylene sulfate, propanol, and 1,3-dioxane, the second conditioner is SOLA SRS (product name made by Divosiva) consisting of polyether denatured silicon, and the third conditioner consists of glacial acetic acid.

In the present invention, the silk products produced generally are submerged in water. In this instance, there is little restriction in kind of the used water, but it is preferable to use underground water or tap water.

Moreover, temperature of water used for submergence of the silk products is within a range of 5° C. to 30° C., the most preferably, 15° C. to 25° C. A submergence time period of the silk products is generally within a range of 10 minutes to 30 minutes, the most preferably, 15 minutes to 20 minutes. After the submergence, the silk products are dehydrated first.

After the first dehydration of the silk products, per silk products of 1 kg, 0.33 g weight of the first conditioner consisting of propanediol, ethanaminium, 2-amino-N-hydroxyethylene sulfate, propanol, and 1,3-dioxane, 1.30 g weight of the second conditioner consisting of polyether denatured silicon, and 40 g weight of the third conditioner consisting of glacial acetic acid are respectively mixed with 15 l of water, and then, the mixture and the silk products are put and rotated in a rotating tub to second dehydrate the silk products. In this instance, a dehydration time period generally ranges 3 minutes to 20 minutes, preferably, 5 minutes to 15 minutes.

Continuously, after the second dehydration step, the silk products are submerged in underground water or tap water again at water temperature ranging from 30° C. to 48° C., the most preferably, 35° C. to 45° C. for 15 minutes to 25 minutes. After the second submergence, the silk products undergo the third dehydration step.

As described above, after the third dehydration step, per silk products of 1 kg, 0.67 g weight of the first conditioner consisting of propanediol, ethanaminium, 2-amino-N-hydroxyethylene sulfate, propanol, and 1,3-dioxane, 2.50 g weight of the second conditioner consisting of polyether denatured silicon, and 60 g weight of the third conditioner consisting of glacial acetic acid are respectively mixed with 15 l of water, and then, the mixture and the silk products are put and rotated in the rotating tub for 5 minutes to 15 minutes. After that, the silk products are finally dehydrated, and then, dried through a generally drying method, whereby the conditioner treating steps are finished.

As described above, the silk products are changed soft and become washable while the above steps of mixing the first to third conditioners of various kinds in the optimum amount, submerging the silk products in water of the proper temperature, and dehydrating them are repeated.

Furthermore, fabric conditioners of three kinds used to provide softness to silk products are indicated as first to third conditioners. The first conditioner is VARI SOFT 222 LM90 (product name made by Gold Shmidt) consisting of propanediol, ethanaminium, 2-amino-N-hydroxyethylene sulfate, propanol, and 1,3-dioxane, and serves to enhance gloss of coated fabrics. Moreover, the second conditioner is SOLA SRS (product name made by Divosiva) consisting of polyether denatured silicon, and serves to make the soft coating minute and solid. Additionally, the third conditioner is glacial acetic acid.

Test of Tensile Strength

A tensile strength of silk stockings treated by the treating method according to the present invention was measured. As a measurement condition, a specimen before the treatment according to the present invention was indicated as a specimen 1, and a specimen treated through the conditioner treating method according to the present invention was indicated as a specimen 2. The tensile strength was measured based on KS K0815:2006 Cut String.

As measurement results, the tensile strength was 22(N/3.0 cm) in the specimen 1 but 26 (N/3.0 cm) in the specimen 2, and hence, it was confirmed that the tensile strength after treatment was more increased about 18% than those before treatment. The test result is shown in the following Table 1.

TABLE 1

| Test Item | Test Result | |
|---|---|---|
| | Specimen 1 | Specimen 2 |
| Tensile Strength (N/3.0 cm): Course Direction (Width) | KS K0815:2006 Cut String 22 | 26 |

*Note)
1 N = 0.10197 kgf
*Note)
1. Size of Specimen: 13 cm × 3 cm
2. Point and grasping distance: 5 cm
3. It was impossible to prescribe the number of tests and only The course direction was tested due to lack of specimens.

Industrial Applicability

As described above, the method of treating fabric conditioner for washable silk products according to the present invention can remove a gum-up phenomenon of the silk products, provide excellent smoothness to the product surface, and decrease whiteness and prevent yellowing during drying of the silk products.

The invention claimed is:

1. A method of treating fabric conditioner for washable silk products comprising the steps of:

(a) submerging silk products in underground water or tap water at temperature ranging from 15° C. to 25° C. for 15 minutes to 20 minutes, and dehydrating them;

(b) after dehydration, mixing 0.33 g weight of the first conditioner consisting of propanediol, ethanaminium, 2-amino-N-hydroxyethylene sulfate, propanol, and 1,3-dioxane, 1.30 g weight of the second conditioner consisting of polyether denatured silicon, and 40 g weight of the third conditioner consisting of glacial acetic acid with 15 l of water per silk products of 1 kg, putting the mixture and the silk products in a rotating tub, and rotating them in the rotating tub for 5 minutes to 15 minutes;

(c) after the (b) step, submerging the silk products in underground water or tap water again at water temperature ranging from 35° C. to 45° C. for 15 minutes to 25 minutes, and dehydrating them;

(d) after dehydration, mixing 0.67 g weight of the first conditioner consisting of propanediol, ethanaminium, 2-amino-N-hydroxyethylene sulfate, propanol, and 1,3-dioxane, 2.50 g weight of the second conditioner consisting of polyether denatured silicon, and 60 g weight of the third conditioner consisting of glacial acetic acid with 15 l of water per silk products of 1 kg, putting the mixture and the silk products in the rotating tub, and rotating them in the rotating tub for 5 minutes to 15 minutes; and (e) dehydrating and drying the silk products.

* * * * *